United States Patent [19]

Gujer

[11] 4,283,019

[45] Aug. 11, 1981

[54] LACER ARM FOR A WINDING MACHINE

[75] Inventor: Peter Gujer, Winterthur, Switzerland

[73] Assignee: Rieter Machine Works, Ltd., Winterthur, Switzerland

[21] Appl. No.: 60,590

[22] Filed: Aug. 29, 1979

[51] Int. Cl.[3] ..... B65H 54/02; B65H 67/04

[52] U.S. Cl. ..... 242/18 A; 242/18 PW

[58] Field of Search ..... 242/18 PW, 18 A, 25 A, 242/25 R, 18 R

[56] References Cited

U.S. PATENT DOCUMENTS

| | | | |
|---|---|---|---|
| 3,856,222 | 12/1974 | Wust | 242/18 A |
| 3,920,193 | 11/1975 | Gujer et al. | 242/18 A |
| 3,964,721 | 6/1976 | Owens et al. | 242/18 PW |
| 4,033,519 | 7/1977 | Abe et al. | 242 18 A/ |
| 4,083,505 | 4/1978 | Burkhardt | 242/18 PW |
| 4,114,820 | 9/1978 | Lafeber | 242/18 A |
| 4,136,834 | 1/1979 | Tschentscher | 242/18 PW |

*Primary Examiner*—Stanley N. Gilreath

*Attorney, Agent, or Firm*—Kenyon & Kenyon

[57] ABSTRACT

In a bobbin revolver, comprising bobbin-carrying chucks mounted on a carrier head which is rotatable to move them successively into a winding position where they receive synthetic filament, a lace-up arm is provided to hold filament in a suitable disposition during lacing up of the revolver so that the filament can be taken up automatically by a chuck moving into the winding position.

15 Claims, 10 Drawing Figures

PRIOR. ART

LACER ARM FOR A WINDING MACHINE

The present invention relates to a machine for winding synthetic filament. In this specification, the term "filament" refers to both mono-filamentary and multi-filamentary material.

The invention relates particularly to a winding machine comprising a plurality of chucks mounted on a carrier head which is rotatable to bring the chucks successively into a winding position. Each chuck is adapted to receive and hold a bobbin for rotation therewith about the chuck axis. When a chuck is in the winding position, a bobbin carried thereby can receive synthetic filament to be wound into a package on the bobbin. Such a machine is referred to hereinafter as a "bobbin revolver". Bobbin revolvers are illustrated and described in U.S. Pat. Nos. 3,856,222 and 3,841,574 and in copending U.S. Patent Application Ser. No. 945,330.

PRIOR ART

It is a common practice to provide on each chuck, either in the chuck structure itself or in a bobbin carried thereby, a filament take-up means which is designed to catch a filament suitably presented to it. The take-up means may also comprise severing means to seperate the secured portion of the filament from the remainder thereof. Where, as is increasingly common, a chuck is designed to carry a plurality of bobbins simultaneously for winding of a corresponding number of packages, there will normally be a corresponding plurality of take-up means associated with the individual bobbin positions on a chuck. Examples of take-up means built into the chuck structure can be found in U.S. Pat. Nos. 4,056,237, 3,310,247 and 4,106,711.

A bobbin revolver must also comprise a filament infeed means for passing filament to the winding position. The filament take-up means is then usually so arranged that as its chuck is moving into the winding position (an "incoming" chuck) the filament take-up means will take-up filament extending between the filament infeed means and windings formed on the chuck which is then leaving the winding position (the "outgoing" chuck). On most occasions, the last said windings will represent a full package of given dimensions. However, the machine design must allow for occasional malfunction such that there may be hardly any windings on the outgoing chuck. The arrangement is normally made such that the incoming chuck will nevertheless take up the filament extending between the filament infeed means and the outgoing chuck. Thus, in normal operation, the machine operator takes no part in the transfer of filament from the outgoing to the incoming chuck.

On the other hand, lacing (or "threading") of the revolver is usually left entirely to the operator. This lacing must occur each time the machine is started up after a shut down and also during normal operation if, for example a filament being fed to the machine should break. The operator normally catches a filament end in a suitable device, such as a suction gun, leads it through the filament infeed means and ensures that it is properly secured to one of the chucks to enable normal operation to begin. This can be a difficult operation even when only one filament is to be wound into a single package at the winding position. Where a number of filaments are to be fed and wound simultanously, the operation can become both intricate and time consuming. Further, in a manually laced revolver, it is not usually possible to form a thread reserve on the first package(s) formed after lacing up because the operator cannot be relied upon to bring the filament into correct relation with the reserve forming mechanism.

Automatic lacing devices designed to lay filament automatically upon one or more bobbins on a single-chuck winding machine have been described in U.S. Pat. Nos. 3,964,721 and 4,083,505. Such lacing devices are similar in general principle to the thread laying device shown in U.S. Pat. No. 3,310,247 in which a filament guide is movable so as to carry a portion of a filament around a portion of the chuck circumference, bringing the filament into engagement with take-up means on the chuck in so doing.

A thread "laying" operation of this type is perfectly satisfactory for use with a chuck designed to rotate about a relatively fixed axis. However it is generally too complex to be co-ordinated with the operation of a bobbin revolver. Thus, although not described in U.S. Ser. No. 945,330, an attempt has been made to provide the revolver shown in that application with a set of lace up guides designed to hold lacing filaments between themselves and the filament infeed means so that the lacing filaments can be taken up automatically by an incoming chuck. Those guides were provided on the base of the revolver, so that the lacing filaments extended across the working zone of the revolver, between the chucks. In this specification, the term "working zone" refers to the space within the largest possible envelope which can be swept out by the chucks and elements carried thereby during chuck movement.

The system was relatively simple in that the lace up guides were fixed in position in the base and did not interfere with the normal operation of the revolver. It has been found, however, that such a system frequently produces an unduly large angle of wrap of the lacing filaments on the incoming chuck, thus producing substantial friction between a filament and the surface contacted thereby on the chuck or bobbin. This in turn can interfere with the relative axial movement which is required between the filament and the take-up means in order to ensure that the filament is securely caught by the take up means and in order to provide a tail and thread reserve on the package.

PRESENT INVENTION

It is an object of the present invention to provide a bobbin revolver in which means are provided to facilitate the lacing operation while avoiding the above difficulties.

The invention provides a bobbin revolver, in which in use each chuck has filament take-up means for catching at least one filament presented thereto, the revolver also comprising (a) filament infeed means for passing filament to a bobbin carried by a chuck in said winding position and such that in normal operation a length of filament (the "take-up length") extending between said filament infeed means and windings on an outgoing chuck is presented to an incoming chuck in a manner enabling the take-up length to be taken up by said take-up means on said incoming chuck, and (b) lace-up means operable during lacing of the revolver prior to normal operation thereof to hold at least one filament between itself and said filament infeed means so that the length of filament extending between the lace-up and infeed means extends along a line which can be adopted in normal operation by said take-up length.

The take-up means is preferably built into the chuck structure, but it may be provided on the bobbin.

The lace-up means may comprise a filament guide and means for holding said guide in a given position relative to said infeed means. The given position is preferably such that the length of filament extending between the infeed means and the lace-up guide extends along a line which is substantially that of a take-up length extending between the infeed means and a full package on an outgoing chuck. The guide clearly cannot remain in the given position during normal operation since it would then interfere with movement of full packages away from the winding position. The holding means may therefore be operable to move the guide between said given position and in an inoperative position in which it will not interfere with normal operation.

Problems can then arise in connection with the disposition of the chucks relative to the infeed means during the lacing operation. It would be possible to arrange the resting positions of the chucks such that the filament guide could be moved directly from the inoperative position to the given position, the filament being passed by the lacing operator from the infeed means to the guide in the given position. However, usually the chucks would not be required to stop in such resting positions during normal operation. Therefore, added complexity would be needed in the control system to cause them to adopt such special resting positions when the machine is temporarily shut down. In the more usual rest arrangement of the chucks, one of them lies in the winding position and another in a doffing position in which a full package can be removed from the chuck during normal operation.

When one of the chucks already lies in the winding position during lacing of the machine, it will be moving away from the winding position as the filament is taken up from the lace-up means by another chuck moving into that position. There is then clearly a risk that the movement of the outgoing chuck will interfere with the filament guide or its holding means or the length of filament extending between the guide and the infeed means. The holding means may therefore be operable to hold the guide in an initial lacing position in which filament can be passed from the infeed means to the guide without intersecting the path of movement of the outgoing chuck, operating means being provided to cause the holding means to move the guide from the initial lacing position to the given position only after the outgoing chuck has moved so far away from the winding position that it will no longer interfere with the holding means, the guide or the length of filament between the guide and the infeed means.

Either or both of the filament infeed means and lace-up means may comprise means operable to shift the filament generally axially of an incoming chuck in order to engage the filament with the take up means on said chuck. Such filament shift means is preferably provided as part of the filament infeed means only, since there it can also be used during transfer of filament from one chuck to another in normal operation of the winding machine while the additional provision of the shifting means in the lace-up means is an added complication. In any event, the arrangement must be such that the filament is suitably presented to the take-up means, and this may require that the filament is oriented at a substantially predetermined angle relative to the chuck axis in the take-up zone. The angle will usually be in the region of 90° although some variation from this precise value (say an angle to the chuck axis between 80° and 100°) will usually prove acceptable.

In order to simplify the description and definition above, reference has been made to only a single filament and the corresponding arrangement in the revolver. It will be understood, however, that the chuck may be designed to hold a plurality of bobbins and to wind a corresponding plurality of filaments thereon simultaneously and the lace up means may also adapted to handle each of the filament simultaneously. For example, the lace up means may comprise a plurality of guides corresponding with the number of filaments be wound, although these guides are preferably carried by a single holding means. In any event, the holding means is preferably pivotable between the various positions referred to above. Movement of the holding means to carry the guides between said positions may be effected by fluid pressure operated means, e.g. a piston and cylinder unit—preferably pneumatically operated.

BRIEF DESCRIPTION OF THE DRAWINGS

By way of example one embodiment of the invention will now be described with reference to the accompanying diagrammatic drawings, in which.

DETAILED DESCRIPTION OF THE INVENTION

The revolver or winding machine shown in all of the Figures is generally in accordance with copending European Published Application No. 1359, (corresponding to pending U.S. Patent Application Ser. No. 129,625, filed Mar. 12, 1980) the disclosure of which is hereby incorporated in the present specification by reference.

Figure 9:
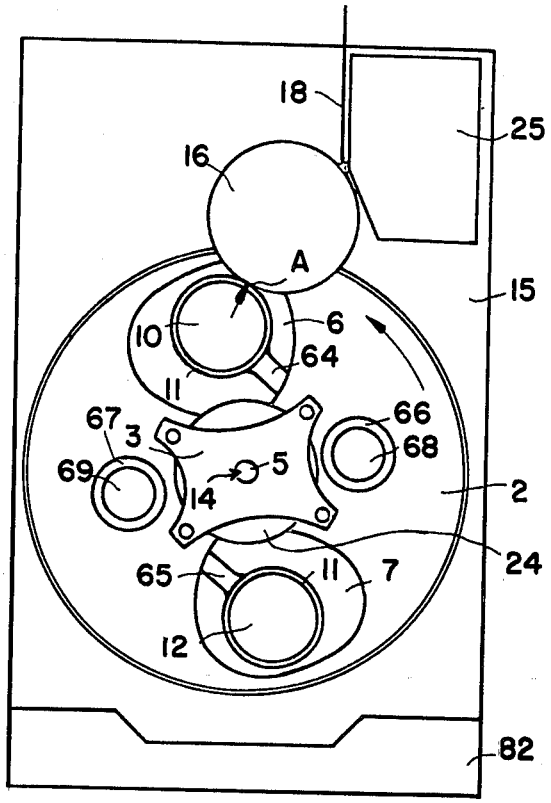
FIGS. 9 and 10 are detailed views showing the general structure of a bobbin revolver in accordance with the invention.

Referring to FIG. 9, the revolver has a frame wall 15 in which a revolving disc 2 is rotatably arranged. The revolving disc 2 is rigidly connected to a support diaphram 3 which in turn is rigidly connected with a drive shaft 5 located coaxially of the disc 2 and rotatable about its own longitudinal axis 14. The revolving disc 2 contains two openings 6, 7 through which two bobbin chucks 10, 12 pass. The bobbin chucks 10, 12 are of such a length that two bobbin tubes 11, 13 (FIG. 4) can be taken up side by side per chuck in order to permit simultaneous winding of two or more packages.

Figure 10:
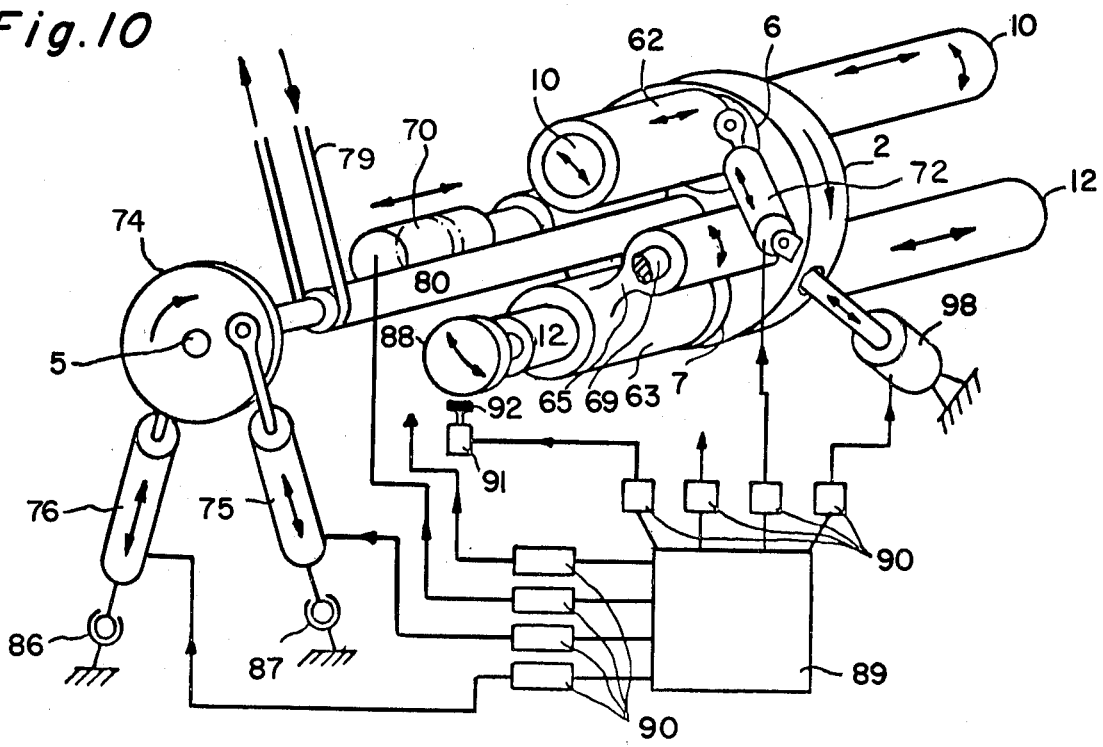

Referring to FIG. 10, the apparatus has a means mounted on the disc 2 for moving each bobbin chuck 10, 12 axially with respect to the disc 2 between a working position and a retracted position as well as means for pivoting each bobbin chuck 10, 12. The disc 2 thus functions as a carrier head for the chucks.

As shown, the means for pivoting the chucks 10, 12 includes a pair of hollow cylinders 62, 63 on the drive side of the apparatus which are disposed on the bobbin chucks 10, 12 in relatively rotatable manner. The hollow cylinders 62, 63 are fixedly connected via arms 64, 65 (FIG. 9) with bearing sleeves 66, 67 which are rotatably mounted on shafts 68, 69. Each shaft 68, 69 is axially and rotatably mounted in the revolving disc 2. In addition, the pivoting means has cylinder means, in the form of pneumatic or hydraulic cylinders, only one of which (72) can be seen in FIG. 10, which are pivotally mounted on the disc 2 and connected to a respective cylinder 62, 63 for pivoting the cylinder 62, 63 about the respective shaft 68, 69. Each bobbin chuck 10, 12 can thus be pivoted about an axis parallel to and radially offset from an accelerating ring 24 in order to position a bobbin tube received on the chuck 10, 12 in contact with the ring 24 with the chuck in a retracted position and, subsequently, in contact with a drive drum 16.

The means for moving the chucks 10, 12 axially include cylinder means such as pneumatic cylinders, only one of which (70) can be seen in FIG. 10, mounted on the machine structure for axially moving a respective shaft 68, 69. To this end, the bearing sleeves 66, 67 are mounted on the shafts 68, 69 to move axially therewith. When a cylinder, such as cylinder 70, is actuated, the corresponding shaft 68, 69, bearing sleeve 66, 67, cylinder 62, 63 and bobbin chuck 10, 12 are moved axially with respect to the disc 2.

Referring to FIG. 10, when a cylinder 62, 63 is actuated, a bobbin chuck 10, 12 can be pivoted in a radial direction in the zone of the openings 6, 7 about the shaft 68, 69. The openings 6, 7 are sufficiently large, such that sufficient space is available for the desired pivoting movement to be described in the following.

Drive shaft 5 is driven by a turntable 74 (FIG. 10) mounted on the opposite end of the drive shaft 5 and a pair of cylinder means such as pneumatic cylinders 75, 76 secured to the turntable at diametrically opposite points. The pivoting cylinder 75 and the auxiliary cylinder 76 are pivotably mounted on a bottom member 82 (FIG. 9) of the frame via ball joints 86, 87.

A hollow shaft 80 (FIG. 10) is supported concentrically about the drive shaft 5 and in the disc 2 in ball bearings not shown. This hollow shaft 80 is used for driving the accelerating ring 24 which is mounted on the end of the hollow shaft 80 in a recess of the revolving disc 2. The means for rotating the ring 24 also includes a drive belt 79 about the shaft 80 so that the ring can be driven independently of the disc.

The accelerating ring 24 is disposed concentrically of the disc 2 and has a diameter to project into the plane range of the apertures 6, 7.

As shown in FIG. 9, the friction drive drum 16 is supported in the wall 15 above the revolving disc 2. A traversing device 25 is also connected with the wall 15 which wall 15 merges into the bottom member 82.

All process steps during the winding operation and during the automatic bobbin change in the winding apparatus are controlled by an electronic control unit 89 via electromagnetic valves 90 (FIG. 10). Assume that during the winding process, threads 18, 20 (FIG. 4) are traversed to and fro by the traversing device 25 and transferred to the friction drive drum 16 and, in known manner, are wound onto the bobbin packages being built up on the tubes 11, 13 which are placed on the bobbin chuck 12 which is then in the winding position, i.e., the reverse of the condition illustrated in FIG. 9. The bobbin package is driven by the friction drive drum 16.

Before the almost completed bobbin packages built up on chuck 12 are automatically exchanged against the empty chuck 10, the latter onto which the empty tubes 11, 13 have been placed, is retracted by the pneumatic cylinder 70 (FIG. 10) axially so far towards the revolving disc 2 that the end of the tube 13 is brought into the zone of the accelerating ring 24. Using the pivoting cylinder 72 (FIG. 10), the bobbin chuck 10 is now pivoted about the shaft 68 so far that the tube 13 contacts the accelerating ring 24 and is pressed onto the ring 24. Thereupon, the hollow shaft 80 is set into rotation via the drive belt 79 by the motor (not shown) and is accelerated up to the desired speed. Thus, the bobbin tubes 11, 13 together with the bobbin chuck 10 are accelerated to the desired speed.

As soon as the bobbin chuck 10 has reached the desired speed, the bobbin change is activated and the pivoting cylinder 75 (FIG. 10) starts rotating the revolving disc 2 in the direction of the arrow according to FIG. 9. The now completely wound bobbin packages on chuck 10 are lifted off the friction drive drum 16 by this movement and, at the same time, the tube 13 of chuck 10, still contacting the accelerating ring 24 approaches the friction drive drum 16. The threads 18, 20 are now severed from the full bobbins in known manner and are transferred to the empty tubes 11, 13 in a manner to be described. After the thread transfer, the bobbin chuck 10 is moved axially forward by its pneumatic cylinder 70 towards the winding zone and is simultaneously pivoted by its pivoting cylinder 72 about the shaft 68 away from the accelerating ring 24 so far that the bobbin tubes 11, 13 already rotating at the desired speed are contractingly pressed against the friction drive drum 16.

As soon as the new bobbin tubes have reached the position at which the winding process is started each time, the revolving disc 2 is stopped by an arresting device 98 (FIG. 10), and is held in this position. Thereupon, the threads 18, 20 are caught by the thread traversing device 25 in known manner, are traversed to and fro and are wound onto the empty tubes 11, 13. In this position, the tubes 11, 13 are pressed against the friction drive drum 16 as the pivoting cylinder 72 pivots the bobbin chuck 10 about the shaft 68, the desired contacting pressure being generated by the electronic control unit 89 via a control device of the pivoting cylinder.

During the start of the winding process on a new bobbin package on the chuck 10, the filled bobbin chuck 12 now located above the frame bottom member 82 is braked by means of a brake shoe 92 (FIG. 10) which is actuated by a cylinder 92 to act on a braking disc 88 at the end of the bobbin chuck 12. The bobbin is then expelled onto a take-up device (not shown). Upon expulsion of the bobbin, the arresting device 98 for the revolving disc 2 is released and the revolving disc 2 is brought into a position corresponding to the bobbin package diameter built on the bobbin tube 10. The contacting pressure of the bobbin packages being built on the bobbin tube 10 onto the friction drive drum 16 is now effected by the pivoting cylinder 75 which is controlled by the control unit 89, in such a manner that the revolving disc 2 is correspondingly rotated, until the package build is completed. Upon completion of the bobbin package build to the desired bobbin package diameter, the package change process described above is repeated.

The above description has dealt with the mechanical structure and operations associated with a changeover operation. It is now necessary to consider the behavior of the threads 18, 20 during such an operation, and this will be done by reference to FIGS. 1 and 2 in which chuck 10 is assumed to be currently in the winding position.

Figure 1:
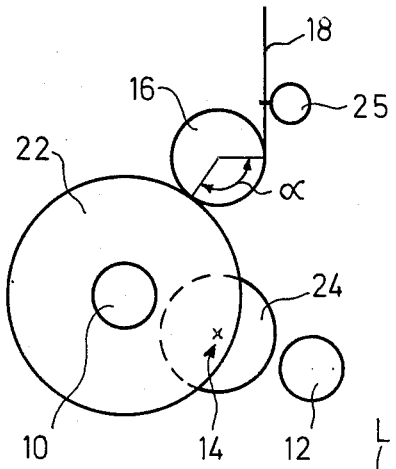
FIGS. 1, 2 and 3 represent similar views of a bobbin revolver in accordance with the prior art but showing the revolver in respective different stages of operation.
Figure 2:
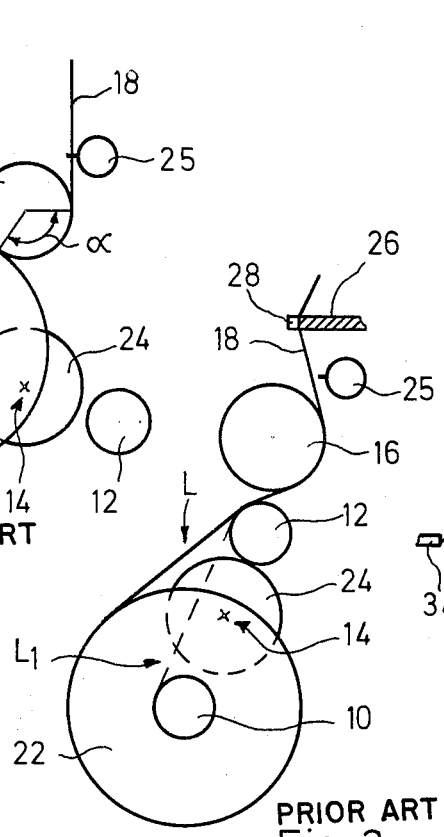
PRIOR ART Fig. 2
Figure 3:
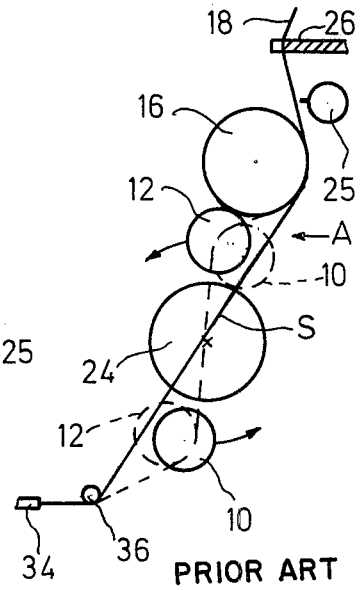
PRIOR ART Fig. 3
Figure 4:
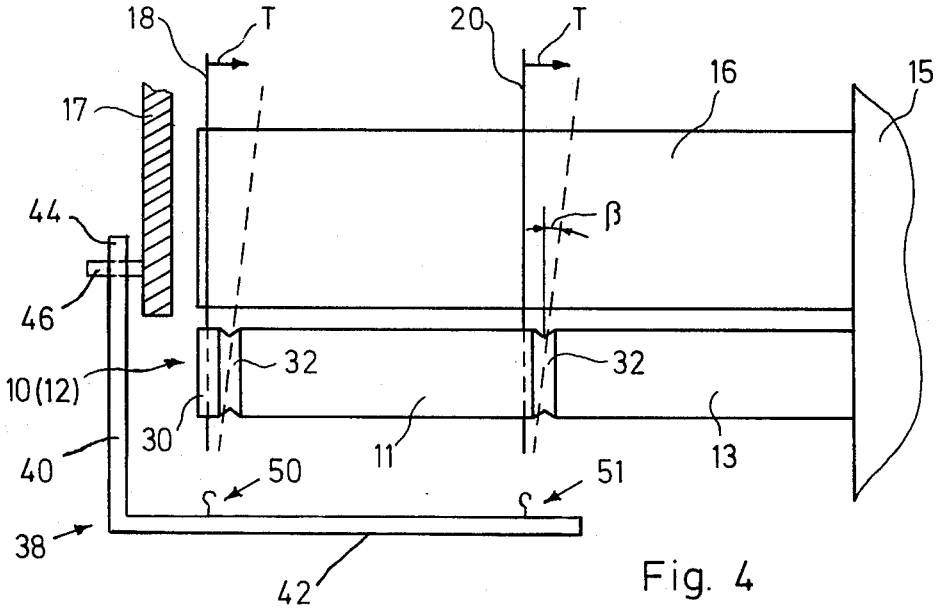
FIG. 4 is a view looking in the direction of the arrow A in FIG. 3 but showing also a modification of the bobbin revolver to bring it into accordance with the present invention.

The filaments to be wound are indicated at 18, 20 in FIG. 4, but only the outboard filament 18 can be seen in FIGS. 1 to 3. The filaments come from the spinneret and are received by an infeed means on the revolver; in the drawings, the final section of this infeed means is provided by a portion of the outer circumference of the friction drive roller 16 (as indicated by the angle $\alpha$ in FIG. 1). The filaments are then wound on respective bobbins on the chuck which is in the winding position to form cross-wound packages 22 (only one of which is shown in FIGS. 1 and 2). Suitable means (not shown) are provided in the chuck structure to secure the bobbin tubes to the chuck structure for rotation therewith. During a changeover operation, the anticlockwise rotation of the carrier head moves the packages 22 away from the driver roller 16 and a length L (FIG. 2) of the filament 18 extends between the outgoing package 22 and the drive roller 16. There is a similar length L of filament 20, but this cannot be seen in FIG. 2. Both the filaments continue to be wound into the packages 22 on the chuck 10 because of the rotational inertia of the rapidly rotating packages on that chuck. Also, the filaments remain in engagement with the traverse mechanism 25 so that the final windings on the packages 22 are also of the crosswound form.

When the system reaches approximately the condition shown in FIG. 2, a plate-like member 26 is moved from right to left as viewed in the FIG. 2 to shift the filaments 18, 20 out of the traverse mechanism 25. The plate 26 or an opposed plate (not shown) co-operating therewith, has a pair of cutout sections to catch and retain the filaments 18, 20, e.g. the cutout section 28 seen in FIG. 2. This arrangement is also well known and it is shown for example in U.S. Pat. Nos. 4,019,690 and 3,920,193. The cutouts 28 hold the filaments in positions shown in full lines in FIG. 4 so that as the chuck 12 intersects the lengths L (the "take up lengths") of the filaments, filament 18 engages a receiving surface 30 formed on the outboard end of each chuck, and filament 20 engages the bobbin 11 near the inboard end thereof. The plate 26 is now moved rapidly in the direction of the arrows T shown in FIG. 4, moving the filaments also in that direction. The filaments are thereby moved across catching/severing rings 32 built into the structure of each chuck so as to act as a filament take-up means. Suitable rings are described in U.S. Pat. Nos. 3,809,326, 3,811,038 and 4,106,711. However, these rings have only a limited axial extent relative to the chuck 10 or 12 on which they are mounted. The axial dimension of the rings is exaggerated in FIG. 4 for clarity of illustration. Since each filament is moved sideways at only one position, where it engages the plate 26, the filament will probably adopt a disposition with an angle of slightly less than 90° relative to the chuck axis, as indicated schematically by the dotted lines in FIG. 4. The angle by which the filament 20 departs from the right angle position is indicated as $\beta$ in FIG. 4. The illustrated angle is permissible, but this represents approximately the permitted upper limit for the angle $\beta$ since otherwise the filament 20 will bridge the gap between the bobbin tubes 11 and 13 and will not be able to engage the knives on the ring 32. Similar considerations apply to the filament 18.

One reason for the adoption of the angle disposition of the filament 20 is its contact with the bobbin tube 11. This is normally of cardboard, so that there is a substantial degree of friction between the filament and the bobbin surface. The lower portion of the filament as viewed in FIG. 4 is therefore slightly restrained relative to the upper portion which is moved positively by the plate 26. During the normal changeover operation as described above with reference to FIGS. 2 and 4, however, no difficulties are experienced in causing the filament to engage with the ring 32. Each filament is then clamped to the respective ring 32 and severed between the clamping point and the outgoing package 22. The severed portion is wound up on the still rotating package 22; the length of filament 20 extending from the clamping point back to the drive roller 16 is transferred onto the bobbin 13 by reason of the continued movement of the plate 26 in the rightward direction as viewed in FIG. 4; similarly, filament 18 is transferred to bobbin 11. Plate 26 is now withdrawn to the right as viewed in FIG. 2 and the filaments are returned to engagement with the traverse mechanism 25 to allow normal package winding to continue. Meanwhile, the outgoing chuck 10 will have reached the doffing position at or adjacent the lowermost position of the chuck in its path of movement around the axis 14. The chuck will be braked, the bobbin clamps released and the bobbins with the full packages thereon will be removed and replaced by fresh bobbins ready for the next changeover.

The situation is slightly different when the machine must be laced up as shown in FIG. 3. Lace-up must occur after a deliberate shut down of operation or after a thread break. In either case, the carrier head will adopt the rest position in which one chuck (assumed to be the chuck 10) lies in the doffing position and the other chuck lies in or about the winding position. The operator collects the filament ends in a suction gun diagrammatically indicated at 34. The filaments are passed between the drive roller 16 and the traverse mechanism 25 and the plate 26 is moved across to hold the filaments clear of the traverse mechanism but without, at this stage, causing the axial movement described above with reference to FIG. 4. The operator now manipulates the suction gun 34 to engage the filaments with respective guides 36 mounted in the base of the machine, only one guide 36 being visible in FIG. 3. Lengths S of filament now extend across the working zone of the bobbin revolver between the chucks 10 and 12, only the length S of filament 18 being visible in FIG. 3. By pressing a special start button the operator now initiates motion of the carrier head to bring the chuck 10 around into the winding position and to move the chuck 12 into the doffing position as indicated by the arrows attached to these chucks in FIG. 3. Both chucks will engage the filaments during this series of operations, so that the lengths S of the filaments will be distorted to the dotted line positions indicated in FIG. 3; the movement of the plate 26 axially of the chucks will be initiated automatically at a suitable stage of rotation of the carrier head to carry the filaments into alignment with the rings 32 of the incoming chuck as described above with reference to FIG. 4. It will be seen from FIG. 3, however, that a lace up operation of this type results in much larger wrap angle of the filaments about the incoming chuck.

The system described above has been operated successfully with carpet yarns. However, with tyre cord yarn, it has been found that the relatively high friction, particularly between the inboard filament 20 and the bobbin 11, frequently produces an excessively high angle $\beta$ so that the filament 20 bridges the bobbins 11 and 13 and cannot be caught by the ring 32. The problem is less marked with respect to the outboard filament 18, since the receiving surface 30 will be on a metal body and will produce less friction than the surface on the card board bobbin 11. However, the degree of friction between the filament and the receiving surface is not readily controllable, and with the heavier yarn even the outboard filament 18 may sometimes fail to catch in its ring 32.

This problem is solved by the use of the lace-up arm 38 shown in FIGS. 4 to 8. The arm comprises three portions indicated by the reference numerals 40, 42 and 44 respectively. Portions 40 and 42 form an L-shaped formation as seen in FIG. 4 and portion 44 represents an extension of the portion 40. Arm 38 is mounted on the exterior of a hood 17 which is mounted over the drive roller 16, as shown in FIG. 4. Mounting of the arm 38 is effected by means of a pivot mounting 46 so that the arm 38 is pivotable about the axis of the mounting 46 which axis extends parallel to the axis of the roller 16 and the chucks 10, 12. The arm is connected to its pivot mounting in any suitable manner (not shown) so that the portions 40 and 44 extend in opposite directions away from the mounting. A suitable operating means (not shown) is connected to the free end of the extension 44 to cause said pivoting. The preferred type of operating means for the lacer arm is a pressure fluid operated (preferably pneumatically operated) cylinder and piston unit. However, other operating systems may be devised and substituted provided they are capable of effecting the series of operations which will be described below with reference to FIGS. 5 to 8. The portion 42 carries two pigtail guides 50, 51 for a purpose to be described below.

Figure 5:
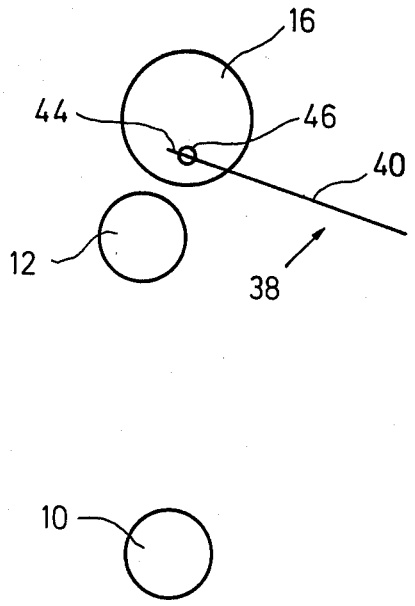
FIGS. 5, 6, 7 and 8 are views similar to FIGS. 1-3 showing the bobbin revolver of FIG. 4 in respective different operational conditions.

FIGS. 5 to 8 illustrate the relative dispositions of the drive roller 16, pivot mounting 46, arm 38 and chucks 10 and 12, as viewed from the front of the machine, during four successive stages of operation of the revolver. In FIG. 5, the revolver is assumed to be in the rest position prior to start up. No filament is being processed. The chuck 10 is assumed to lie in the doffing position and the chuck 12 lies in or about the winding position. Arm 38 is pivoted fully anticlockwise as viewed in the Figures against a suitable stop (not shown). In this disposition of the arm, portion 42 lies wholly outside the working zone of the bobbin revolver, and in particular wholly outside the path of movement of the chucks 10, 12 from the doffing position into the winding position. The arm 38 will be held in the same inoperative position during the normal continuous winding operation described above with reference to FIGS. 1 and 2. Thus, there is no chance that the arm 38 can interfere with that normal operation.

When the revolver is be laced, the operator once again catches the ends of the filaments in a suction gun (not shown in FIGS. 6–8) and presses a lacing initiator button set in a suitable control panel (not shown) on the machine frame. This causes the arm operating means to pivot the arm to an initial lacing position illustrated in FIG. 6 and in FIG. 4. The arm portion 42 now extends into the working zone of the bobbin revolver, lying between the chucks 10 and 12. The space between the drive roller 16 and the traverse mechanism 25 is free to enable the operator to pass the filaments into that space; the operator also causes the plate 26 to move into its leftward disposition as seen in FIGS. 2 and 3 so that the filaments are held free of the traverse mechanism and are located in their respective cutouts 28. The operator now engages the outboard filament 18 with the pigtail guide 50 and the inboard filament 20 with the pigtail guide 51 so that a length Z of each filament extends between the drive roller 16 and the respective pigtail guide. A skilled operator can easily perform this operation with both filament ends being taken up simultaneously by a single suction gun. The initial lacing operation, which is the only part requiring manual skill is now complete and the operator initiates the next stage of the lacing operation by pressing a suitable initiating button on the control panel.

Figure 6:
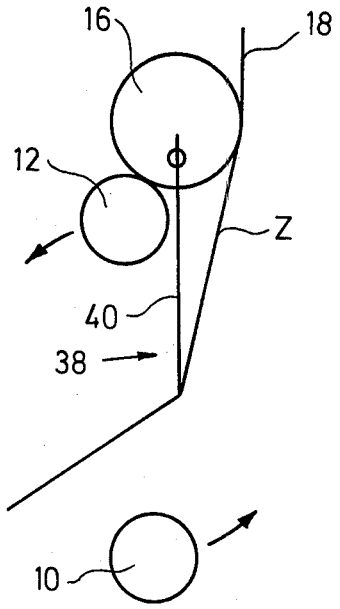

The carrier head now begins to rotate about the axis 14 to move the chuck 12 away from the winding position and the chuck 10 away from the doffing position as indicated by the arrows on those chucks in FIG. 6. When this rotation has reached approximately the stage indicated by the positions of the chucks in FIG. 7, the arm operating means is initiated automatically to pivot the arm 38 in a clockwise direction around the axis of its mounting 46 to the final lacing position shown in FIG. 7. At or about this stage the chuck 12 will engage the filaments downstream of the guides 50, 51, but this has no effect upon the disposition of the filaments length Z which extend between those guides and the roller 16. The final lacing position of the arm 38 is such that the lengths Z adopt substantially the same line as the lengths L described above with reference to FIG. 2, that is, the lines of filaments normally extending between full packages 22 and the drive roller 16 during a normal changeover operation. Pivoting of the arm 38 to its final lacing position is effected at such a stage of rotation of the carrier head that the chuck 12 will not interfere either with the arm portion 42 or with the filament lengths Z.

Figure 7:
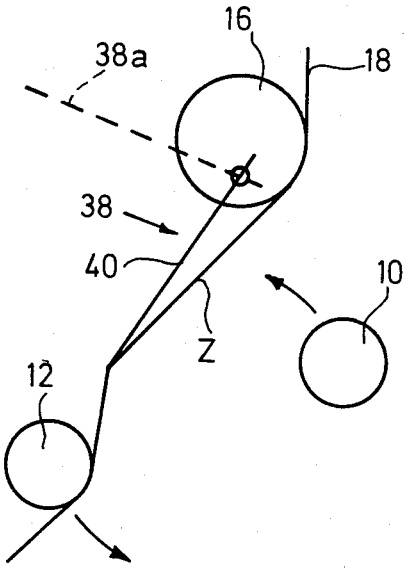
Figure 8:
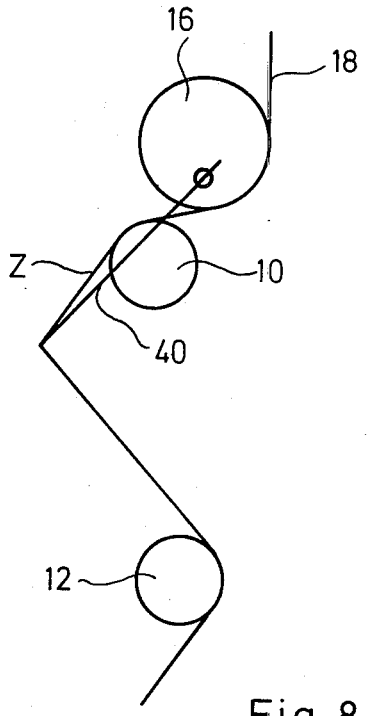

Meanwhile, the chuck 10 will be brought into engagement with the accelerating disc 24 and will be moving towards the winding position as indicated by the arrow on this chuck in FIG. 7. The pigtail guide 50 is so located on the arm portion 42 that the filament receiving portion 30 on the incoming chuck 10 will intersect the length Z of the filament 18. Filament guide 51 is so located on the arm that the length Z of filament 20 will intersect the bobbin tube 11 on the chuck 10 adjacent the ring 32 between the tubes 11 and 13. This intersection stage is indicated in FIG. 8, and it is accompanied by movement of the plate 26 to the right as viewed in FIG. 4 to effect a normal catching and severing operation as already described. In this case, however, the severed portions of the filaments are collected by the suction gun. When the filaments have begun to wind on the bobbin tubes 11, 12, the arm 38 is returned to the inoperative disposition shown in FIG. 5. This should be done as soon as possible after successful clamping of the filament to the chuck 10, since the package diameters build up very rapidly in this early stage of winding and there must be no interference of this build up through contact of the packages with the arm portion 42 and its pigtail guides 50, 51. Operation of the winder now proceeds normally as described with reference to FIGS. 1 and 2.

The invention is not limited to the constructional details of the illustrated embodiments. For the sake of simplicity of description, only two filaments 18 and 20 have been shown in the Figures. In practice chucks may be designed to wind more than two filaments simultaneously, e.g. four-package chucks are now reasonably common in this art. The pigtail guides 50 and 51 may be replaced by other guides, but these should preferably permit easy engagement of the continuous filaments with the guides during the initial lacing operation. The above description has assumed that the plate 26 will continue to be the only source of movement of the filaments longitudinally of the chuck axis during the lacing up operation, so that there will continue to be a displacement angle $\beta$ similar to that indicated in FIG. 4. The above described lace-up arm 38 then functions to limit the wrap angle of the filaments around the incoming chuck and the bobbins carried thereby, reducing friction between the filaments and the incoming chucks/bobbins and thereby limiting the angle $\beta$ to a value within a predetermined maximum dependent on the construction of the ring 32. The normal ring construction at present in use would limit the maximum angle $\beta$ to a value of approximately 5° and preferably to an angle less than 3°. It will be apparent, however, that the angle $\beta$ can be reduced, or even eliminated, by introducing a further source of movement of filament axially of the chuck but downstream of the chuck considered in the direction of movement of the filament, e.g. by causing the arm portion 42 to reciprocate axially of the chuck or by causing the guides 50, 51 to reciprocate axially of the arm portion 42 at the same time as the plate 26 is moved axially of the chuck. However, it would still be undesirable to produce a high wrap angle of the filament around the incoming chuck/bobbins since otherwise a filament may simply adopt a curved formation between the plate 26 and the arm 42 instead of adopting the angle straight line disposition shown in FIG. 4.

The desired controlled wrap angle S of the filaments around the incoming chuck/bobbins should normally be ensured if the lengths Z of filament between the drive roller and the guide 50, 51 when the arm is in the final lace-up position substantially correspond with the positions of the lengths L of filament extending between the drive roller 16 and outgoing full packages 22. However, this exact disposition of the filaments is not essential to the invention. Even in normal operation the machine designer has to anticipate malfunctions such that the winding operation is broken off before the completion of the designed "full package". Thus, it may be necessary to remove a set of bobbins on a chuck when those bobbins have an extremely thin layer of windings thereon, the external diameter of the package then being little more then the external diameter of the bobbin tubes themselves. The "take up lengths" for this condition are indicated in FIG. 2 by the dotted line $L_1$ extending between the incoming chuck 12 and the outgoing chuck 10. This clearly produces an increased wrap angle around the incoming chuck 12 but the system is designed to permit such an increased angle while nevertheless achieving secure catching of filament by the ring 32. The final position of the lace-up arm may produce dispositions of the filament lengths Z corresponding with this "malfunction" operation.

It will be appreciated that if the system were designed so that the carrier head adopted a rest position in which the chucks were disposed in the relative positions illustrated in FIG. 7, then it would no longer be necessary to use a two stage movement to bring the lace up arm from the inoperative disposition to the final lacing up position. In its inoperative position, the arm could be disposed in the dotted line position indicated at 38*a* in FIG. 7, in which it would also be clear of the working zone of the revolver. The arm could then move in a single movement stage to the final lacing position shown in full lines in FIG. 7, since there would be no need to coordinate such movement to the final lacing position with the rotation of the carrier head. However, there is no call for the carrier head to adopt such a rest position during normal operation of the revolver, so that an additional control step would be required to bring it to such a position on the occasions when the machine is shut down. This is an added complication in the construction and control of the machine, and is therefore undesirable. On the other hand, the carrier head will be required to stop during normal operation with the chucks in the disposition shown in FIG. 5 to enable doffing of the completed packages from the outgoing chuck (10 in that Figure). It is desirable therefore, to make this the normal rest position of the carrier head when the machine is shut down.

It will be seen from FIG. 3 that the outgoing chuck (12 in that Figure) can have a substantial influence upon the wrap angle of the filament around the incoming chuck (10 in FIG. 3). In some revolvers, therefore, it may be sufficient for the lace-up arm to adopt an operative position within the working zone but lying inside the path of movement of the outgoing chuck from the winding position towards the doffing position. Such an arrangement would produce a wrap angle around the incoming chuck greater than that obtained with the filament disposition $L_1$ in FIG. 2 but less then that produced with the dotted line arrangement in FIG. 3. Depending upon the filament type and the surfaces upon which the filament has to be moved longitudinally of the chuck, such a reduced wrap angle may be satisfactory. The lace-up arm could then be moved to its operative position directly from an inoperative position either as shown in FIG. 5 or as shown at 38*a* in FIG. 7. Where the lace-up arm can immediately adopt its final lacing position, i.e. there is no need to coordinate a movement of the lace-up arm with movement of the chucks during the lacing operation, it could be convenient to build only a mounting for the lace-up arm into the revolver structure and to have a seperate arm which is connected to its mounting by the operator only during the actual lacing operation, being removed from the winder structure as soon as the lacing operation is complete. Such an arrangement would also be possible with the automatically moving lacing arm described above, but the arrangement would have to be more complicated because of the need to interconnect the arm with the moving means therefor and this is therefore unlikely to be a desirable option.

It will be seen that in its preferred form the invention provides a lace-up means operable to hold a length of filament in a disposition which can be adopted by a takeup length of filament during normal operation of the revolver. However, in some modified forms the lace-up means may be operable simply to hold a length of filament in a disposition which produces a lower wrap angle of said length of filament around the incoming chuck than would be produced if the outgoing chuck were permitted to carry said length of filament before it towards the doffing position.

What is claimed is:

1. A winding machine comprising a rotatable carrier head having a longitudinal axis;

a plurality of chucks rotatably mounted on said carrier head and disposed in parallel on said carrier head for rotary movement between a winding position and a doffing position, each chuck having filament take-up means for catching at least one filament presented thereto and being adapted to removably mount a bobbin thereon for receiving a filament thereon in said winding position;

filament infeed means for passing filament to a bobbin carried on a chuck in said winding position and such that in normal operation a take-up length of filament extending between said filament infeed means and a chuck moving from said winding position is presented to a second chuck moving to said winding position in a menner enabling the take-up length to be taken up on said take-up means on said second chuck, and lace-up means movable, during lacing of the machine prior to normal operation thereof, from a position outside the working zone of the machine to a position inside said zone to hold at least one filament between said lace-up means and said filament infeed means so that the length of filament extending between said lace-up means and said infeed means can be taken up by a chuck moving to said winding position.

2. A machine as claimed in claim 1 wherein said position inside the working zone is such as to prevent the outgoing chuck increasing the wrap angle of said length of filament on the incoming chuck.

3. A bobbin revolver comprising a rotatable carrier head having a longitudinal axis;

a pair of chucks rotatably mounted on said carrier head and disposed in parallel on opposite sides of said longitudinal axis of said carrier head for rotary movement between a winding position and a doffing position;

a pair of bobbins, each said bobbin being removably mounted on a respective chuck to receive a filament thereon in said winding position;

infeed means for feeding at least one filament to said winding position;

a filament take-up means on each chuck for catching at least one filament presented thereto; and lace-up means for holding thereon at least one filament extending between said infeed means and said lace-up means, said lace-up means being movable into a holding position to dispose the legnth of filament between said infeed means and said lace-up means along a given line across the path of movement of a respective chuck between said doffing position and said winding position whereby a chuck moving from said doffing position into said winding position receives the filament held on said lace-up means with a predetermined angle of wrap corresponding to a length of filament extending between said infeed means and a full package on a chuck moving from said winding position to said doffing position.

4. A bobbin revolver as set forth in claim 3 wherein said lace-up means includes an L-shaped arm pivotally mounted on an axis parallel to said longitudinal axis of said head, said arm having one portion extending parallel to said longitudinal axis to move between a first position remote from said head to said holding position.

5. A bobbin revolver as set forth in claim 4 wherein said lace-up means further includes at least one pigtail guide on said one portion for engaging a respective filament.

6. A winding machine comprising:

a carrier head rotatable about an axis;

a plurality of chucks mounted on said carrier head to successively move into and out of a winding position upon rotation of said carrier head about said axis, each said chuck being rotatable about a respective chuck axis thereof to receive and hold a bobbin thereon for rotation therewith, each said chuck including a filament take-up means for catching at least one filament presented thereto;

filament infeed means for passing a filament to a bobbin on a respective chuck in said winding position; and a lace-up means for holding at least one filament passing from said infeed means, said lace-up means being pivotal into a lacing position to hold the filament along a line between said infeed means and said lace-up means to present the filament to said take-up means on a respective chuck during movement of said respective chuck into said winding position.

7. A winding machine as set forth in claim 6 wherein said filament infeed means comprises means operable to shift the filament generally axially of a respective chuck in order to engage the filament with said take-up means on said respective chuck.

8. A winding machine as set forth in claim 7 wherein said take-up means is built into each chuck.

9. A winding machine as set forth in claim 6 wherein said lace-up means includes a filament guide.

10. A winding machine as set forth in claim 9 wherein said lace-up means further includes a holding means for holding said guide and an operating means for moving said holding means to shift said guide between said lacing position and an inoperative position spaced from said chucks.

11. A winding machine as set forth in claim 10 wherein said carrier head is movable into a rest position and said holding means is movable with said carrier in said rest position to sequentially shift said guide from said inoperative position into an initial lacing position with a chuck in said winding position and into a final lacing position with said latter chuck spaced from said winding position a distance sufficient to avoid interference with said holding means, said guide and a length of filament between said guide and said infeed means.

12. A winding machine as set forth in claim 10 wherein said holding means includes a pivot and a pivotal member pivotally mounted on said pivot, said operating means being adapted to pivot said member on said pivot.

13. A winding machine as set forth in claim 10 wherein each chuck is sized to hold a plurality of bobbins and to wind a corresponding plurality of filaments therein simultaneously and said holding means holds a corresponding plurality of guides for receiving respective filaments during lacing.

14. A winding machine comprising a carrier head rotatable about an axis;

a plurality of chucks mounted on said carrier head to successively move into and out of a winding position upon rotation of said carrier head about said axis, each said chuck being rotatable about a respective chuck axis thereof to receive and hold a bobbin thereon for rotation therewith, each said chuck including a filament take-up means for catching at least one filament presented thereto;

filament infeed means for passing a filament to a bobbin on a respective chuck in said winding position; and a lace-up means for holding at least one filament passing from said infeed means, said lace-up means being locatable in a lacing position prior to normal operation of said machine to hold the filament along a line between said infeed means and said lace-up means to present the filament to said take-up means on a respective chuck during movement of said respective chuck into said winding position, said line corresponding to a line which can be adopted in said normal operation by a length of filament between said infeed means and a chuck moving from said winding position.

15. A method of lacing-up a winding machine having a rotatable carrier head, a plurality of chucks mounted on the carrier head to successively move into and out of a winding position upon rotation of said carrier head, each chuck including a filament take-up means for catching at least one filament presented thereto, and filament infeed means for passing a filament to a respective chuck in said winding position, said method comprising the steps of holding a filament passing from the filament infeed means at an intermediate point thereof in a position corresponding to a point in a path of a filament fed from the infeed means to a chuck moving from said winding position during normal operation; and moving a respective chuck into said winding position while holding the filament at said position to engage the filament take-up means of said respective chuck with the filament between the infeed means and said position.

* * * * *

UNITED STATES PATENT AND TRADEMARK OFFICE

CERTIFICATE OF CORRECTION

PATENT NO. : 4,283,019

DATED : August 11, 1981

INVENTOR(S) : Peter Gujer

It is certified that error appears in the above—identified patent and that said Letters Patent is hereby corrected as shown below:

Column 4, line 11, after "may also" insert --be--

Column 4, line 14, after "of filaments" insert --to--

Column 12, line 33, after "but less" change "then" to --than--

Column 12, line 46, change "seperate" to --separate--

Column 13, line 16, after "position in a "change "menner" to --manner--

Signed and Sealed this

*Eighth* Day of *December 1981*

[SEAL]

*Attest:*

GERALD J. MOSSINGHOFF

*Attesting Officer*

*Commissioner of Patents and Trademarks*